US005547544A

United States Patent [19]

Miyamoto et al.

[11] Patent Number: 5,547,544

[45] Date of Patent: Aug. 20, 1996

[54] METHOD OF MOLDING SHAPED PULP ARTICLES FROM FIBER PULP

[75] Inventors: Yasuhiro Miyamoto, Handa; Toshiaki Ishihara, Nagoya; Minoru Uda, Handa, all of Japan

[73] Assignee: NGK Insulators, Ltd., Japan

[21] Appl. No.: 383,853

[22] Filed: Feb. 6, 1995

Related U.S. Application Data

[62] Division of Ser. No. 24,776, Mar. 2, 1993, Pat. No. 5,431, 784.

[30] Foreign Application Priority Data

| | | | |
|---|---|---|---|
| Mar. 6, 1992 | [JP] | Japan | 4-49355 |
| Jun. 11, 1992 | [JP] | Japan | 4-151956 |
| Sep. 3, 1992 | [JP] | Japan | 4-235928 |
| Feb. 24, 1993 | [JP] | Japan | 5-35839 |

[51] Int. Cl.[6] ..... B01D 24/46

[52] U.S. Cl. ..... 162/199; 162/272

[58] Field of Search ..... 425/84, 85; 264/86, 264/87; 249/131, 141; 162/272, 274, 225, 389, 410, 199; 210/393, 772, 411

[56] References Cited

U.S. PATENT DOCUMENTS

| | | | |
|---|---|---|---|
| 1,413,178 | 4/1922 | Manson . | |
| 2,859,669 | 11/1958 | Leitzel . | |
| 3,132,991 | 5/1964 | Hornbostel et al. . | |
| 3,228,826 | 1/1966 | Eastman et al. | 162/218 |
| 3,325,349 | 6/1967 | Reifers . | |
| 3,542,198 | 11/1970 | Borjeson . | |
| 3,619,353 | 11/1991 | Williams . | |
| 3,985,656 | 10/1976 | Arvanitakis . | |
| 4,500,435 | 2/1985 | Muller . | |

FOREIGN PATENT DOCUMENTS

| | | |
|---|---|---|
| 3837467 | 5/1990 | Germany . |
| 60-9704 | 1/1985 | Japan . |
| 945781 | 1/1964 | United Kingdom . |
| 1589077 | 5/1981 | United Kingdom . |
| 2251402 | 7/1992 | United Kingdom . |
| 9000944 | 2/1990 | WIPO . |
| 90/04679 | 5/1990 | WIPO . |

*Primary Examiner*—Brenda A. Lamb

*Attorney, Agent, or Firm*—Parkhurst, Wendel & Burr, L.L.P.

[57] ABSTRACT

A mold composed of bonded water-insoluble particles and having a molding layer and a support layer. The molding layer includes first water insoluble particles, having an average size of 0.2 –1.0 mm bonded to form a layer having a thickness 1–20 times the average size of the first particles. The support layer positioned on the inner surface of the molding layer, on which the fiber bodies are not formed, includes second water-insoluble particles, having an average size of 1.0–10.0 mm, bonded to form a layer having a thickness of at least the average size of the second particles. The pulp mold has advantages in that it hardly suffers from clogging, it produces fiber bodies each having a smooth surface, it is free from damage caused by repeated use, and it produces fiber bodies in a short period of time.

5 Claims, 14 Drawing Sheets

METHOD OF MOLDING SHAPED PULP ARTICLES FROM FIBER PULP

BACKGROUND OF THE INVENTION

This is a division of application Ser. No. 08/024,776 filed Mar. 2, 1993, now U.S. Pat. No. 5,431,784.

This invention relates to a pulp mold for producing fiber bodies from used pulp and the like. Such fiber bodies are suitably used as packaging and shock-absorbing materials, for example, egg boxes, fruit crates, packages for industrial products. This invention also relates to the method for producing such fiber bodies.

Conventionally, in Japan, plastic and styro-foam containers have mainly been used for packing industrial products or the like as shock absorbers. However, such containers add to environmental problems since they are not biodegradable, they release hazardous gas upon incineration, and so on. Therefore, conversion to fiber containers using old pulp, which can be re-formed many times, has come to be investigated.

The conventional pulp mold having a complex structure is formed into a desired shape by joining blocks made of aluminum or the like, each block having numerous pores for water passage, and at least the molding surface of each block is covered by a wire net. Washing the mold using a shower of water at each interval of molding can prevent, to some extent, the water passages from becoming clogged. However, washing complex-shaped molds is extremely time consuming. Moreover, there are problems such as (1) the need for much time and high level of skill in the production of molds having complex shapes as described above, (2) the difficulty in eliminating unwanted marks of the joints and patterns of the wire net from the surface of the final product, and (3) the inability to form letters or minute designs since the wire conventionally used cannot produce precise edges and corners. Further, when the pores for water passage are clogged, the operation has to be stopped and the mold is washed by pressurized water.

Another type of pulp mold has been proposed in Japanese Patent Laid-Open 60-9704 by Dalken. This discloses a single layer of particles forming the molding surface, of a size chosen to provide a smooth surface. The thickness of this layer is 5-60 mm. There may be a backing plate having apertures. In actual use, this mold will clog, because the large areas of tile molding layer are directly backed by unapertured areas of the plate. Backwashing is not described.

The present invention intends to solve the above-discussed conventional problems by providing a pulp mold for producing fiber bodies, which: (1) suffers little clogging of water passages. (2) can produce fiber bodies having smooth surfaces, (3) is not prone to be damaged by repeated use, and (4) can be easily produced in a short amount of time. With the present invention, the critical number of possible continuous pulp moldings can be greatly increased.

The present invention is further intended to provide a pulp molding process, a molding apparatus, and a shaped pulp article, using the above-discussed pulp mold, to greatly increase the critical number of possible continuous pulp moldings.

SUMMARY OF THE INVENTION

According to the present invention, there is provided a mold for producing fiber bodies, the mold being composed of bonded water-insoluble particles, the mold being characterized in having a molding layer and a support layer. The molding layer consists of first water-insoluble particles, having an average size (i.e., nominal diameter) of 0.2–1.0 mm bonded to form a layer having a thickness 1–20 times the average size of the first particles. The support layer positioned on the inner surface of the molding layer, on which the fiber bodies are not formed, consists of second water-insoluble particles, having an average size (i.e., nominal diameter) of 1.0–10.0 mm, bonded to form a layer having a thickness of at least the average size of the second particles.

According to the present invention, there is also provided a mold for producing fiber bodies, the mold comprising: a molding surface on which fiber bodies are formed, a molding layer providing at least part of said molding surface, formed by bonding particles, and a support layer supporting the molding layer, formed by bonding particles having a larger average diameter than the particles used in the molding layer, wherein the molding layer and/or the support layer possess(es) water-retaining property (capillary attraction) by the structure that particles are mutually bonded so as to have pores.

In addition to the molds described above, the present Invention relates to a method of producing fiber bodies, comprising the steps of: (1) providing a pulp mold having a molding surface provided by a body of particles bonded together, the particle sizes of the particles and the thickness of the body being selected such that the body possesses water-retaining property (capillary attraction), (2) repeatedly molding pulp articles on the molding surface by suction through the mold, and (3) after the molding of each fiber body, or each time after the sequential molding of a plurality of the fiber bodies, applying cleaning water to said mold after removal of a fiber body from the mold to incorporate water in said body of particles and after that applying air pressure to the body of the mold from inside the mold to drive said incorporated water from the mold to remove fibers trapped in said body of particles.

The present invention also proposes an apparatus for producing fiber bodies, comprising: (1) a pulp mold having a molding surface provided by a body of particles bonded together, the particle sizes of the particles and the thickness of the mold being selected such that mold is able to hold water by capillary attraction, said mold having an inside surface remote from the molding surface, (2) means for adding cleaning water to the mold so that cleaning water is incorporated in the body of particles, and (3) means for applying air pressure to the inside surface of the mold to drive water from the body of particles.

DETAILED DESCRIPTION OF THE INVENTION

In the pulp mold of the present invention, particles having given diameters are formed to make a molding layer having a given thickness. Therefore the pulp mold has such advantages that fibers are not easily sucked in the layers, that fibers sucked in the layer(s) can easily pass the layers without being trapped, that clogging is hardly caused because trapped fibers can be easily removed by a counter flow, and that the surface of each obtained fiber body is smooth and clean. The pulp mold also has advantages that passage of fiber pieces shorter than a certain length is positively promoted so that the clogging is prevented. Because the support layer positioned on the inner surface of the pulp mold consists of particles having a larger diameter than the particles of the molding layer, the molding layer can be highly and uniformly pressurized from within for effective washing without any damage to the pulp mold. The mold can also be effectively washed by a conventional method which involves spraying the molding surface with pressurized water.

The method for producing fiber bodies by the present invention includes (1) the immersion of the pulp mold in a slurry of pulp or tile like, (2)the reduction of pressure within the mold so as to cause the uptake of the slurry by the mold, (3) the extraction of the mold from the slurry, (4) the reduction of the inner pressure of the mold for the removal of moisture from the mold surface, and (5) the separation of the resulting concentrated pulp from the mold. Then, the molding layer and supporting layer are washed by a counter flow using water and vapor by soaking at least the molding layer with water and impulsively pressurizing by compressed air or the like inside the mold. By adding the washing process once in one or several moldings, the mold is freed from clogging and can be used in a continuous operation for producing fiber bodies repeatedly.

The apparatus for producing fiber bodies in the present invention comprises (1) a pulp mold having a molding surface provided by a body of particles bonded together, the particle sizes of the particles and the thickness of the mold being selected such that the mold is able to hold water by capillary attraction, said mold having an inside surface remote from the molding surface, (2) means for adding cleaning water to the mold so that cleaning water is incorporated in the body of particles, and (3) means for applying air pressure to the inside surface of the mold to drive water from the body of particles. Therefore, the mold is prevented from clogging effectively, and continuous molding is made possible.

The present invention is hereinafter described in more detail with reference to tile examples illustrated in the attached drawings.

Figure 1:
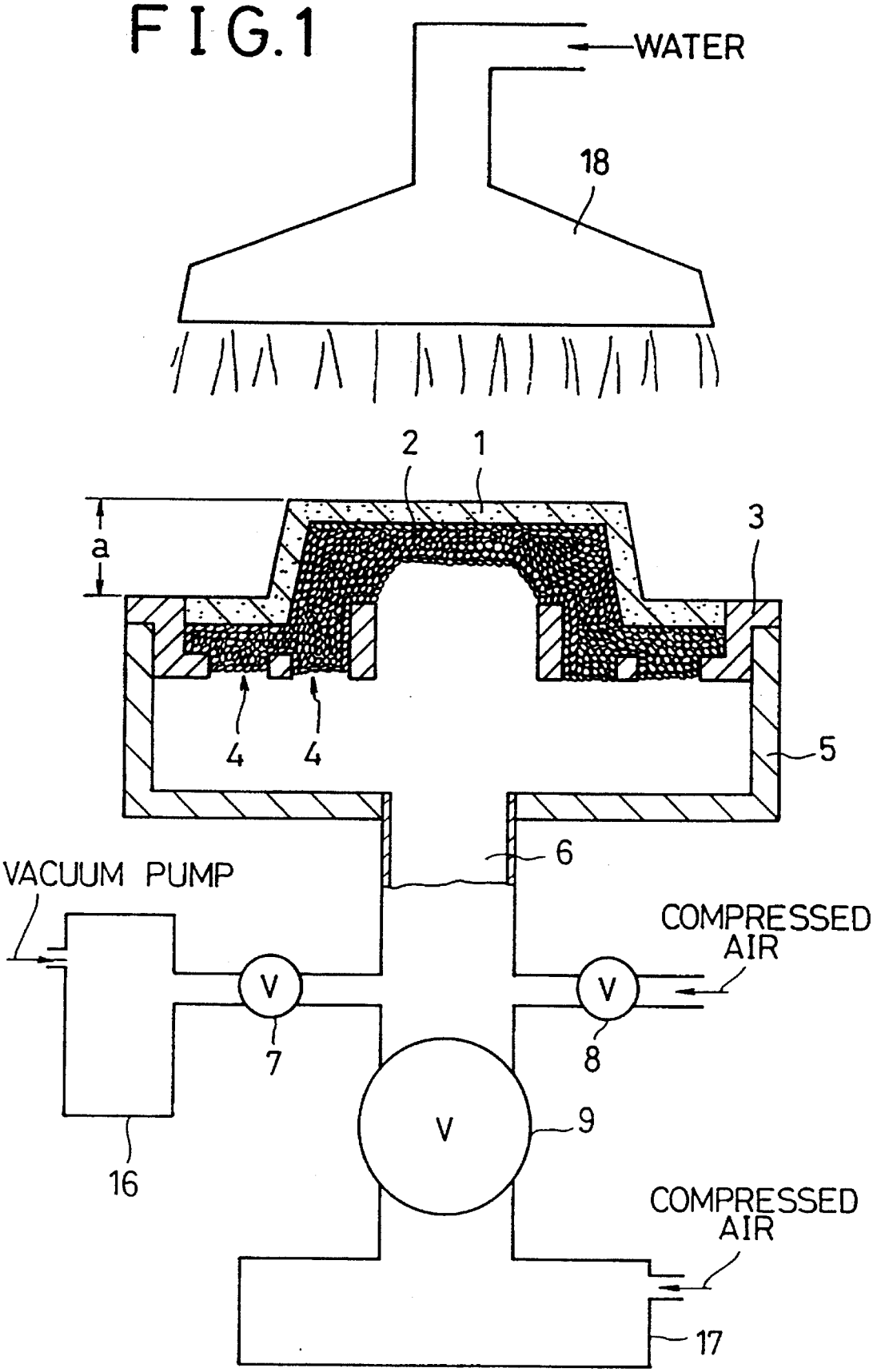
FIG. 1 is a sectional view of the mold showing an example of the present invention.

FIG. 1 shows an example of a molding apparatus using a pulp mold of the present invention. Reference numeral denotes a molding layer having a molding surface, while 2 denotes a support layer adjacent to the inner surface of the molding layer 1 integrated with a rigid body 3 having apertures 4 for water passage, and the rigid body 3 is connected to a chamber 5. The chamber 5 is connected to a vacuum chamber 16 through a pressure modulation tube 6 and a vacuum valve 7 for molding, to a compressor through a pressurizing valve 8 for separation of fiber bodies, and to a pressurizing chamber 17 through a pressuring valve 9 for backwashing. The vacuum chamber 16 is connected to a vacuum pump unshown in the figure, and the pressurizing chamber 17 is connected to a compressor unshown in the figure. The valves 7, 8 and 9 are electromagnetic. A shower 18 is set on the upper side of the mold so that the entire molding surface of pulp mold is sprayed with water after an obtained fiber body is separated therefrom.

The molding layer consists of first water-insoluble particles having a diameter of 0.2–1.0mm which are bonded by a resin bonding agent or the like to form a layer 1–20 times thicker than the average particle diameter size of the first particles.

The materials used as the particles of the molding layer can be any water-insoluble material such as glass, ceramic, synthetic resin, or metal. Among them, glass beads are most suitable in view of controllabillty of particle diameter size.

Figure 10:
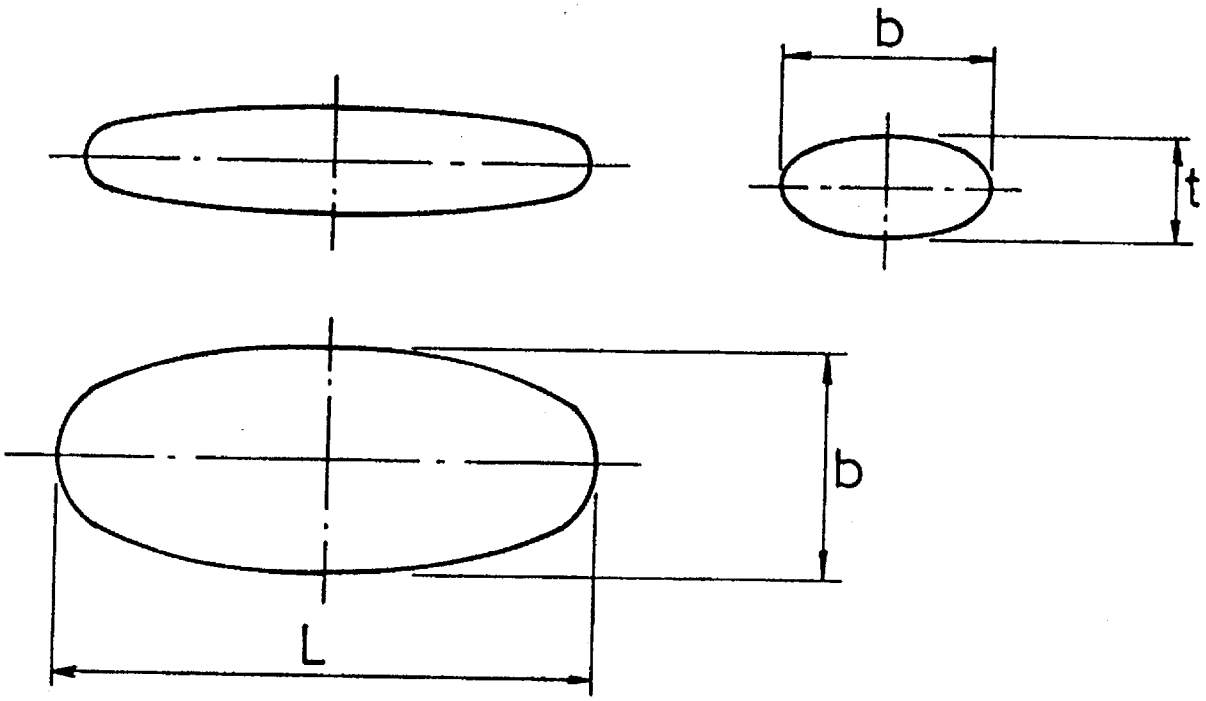
FIG. 10 is an explanatory view showing the relation between the long diameter, the short diameter, and the thickness of flat oval particles.
Figure 11:
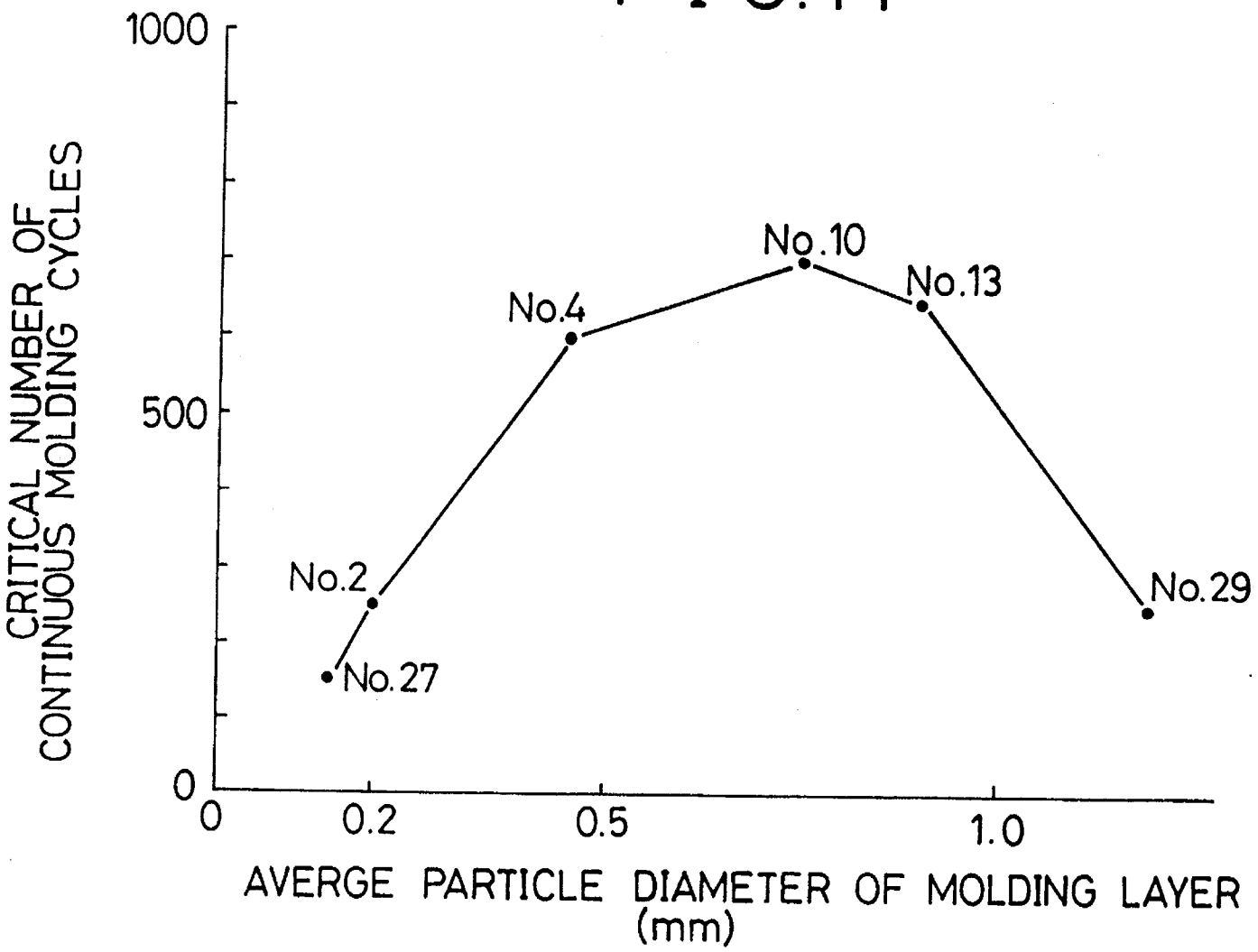
FIG. 11 is a graphic chart showing the critical number of continuous moldings depending on the average particle diameter of the molding layer of the mold in Example 1.
Figure 12:
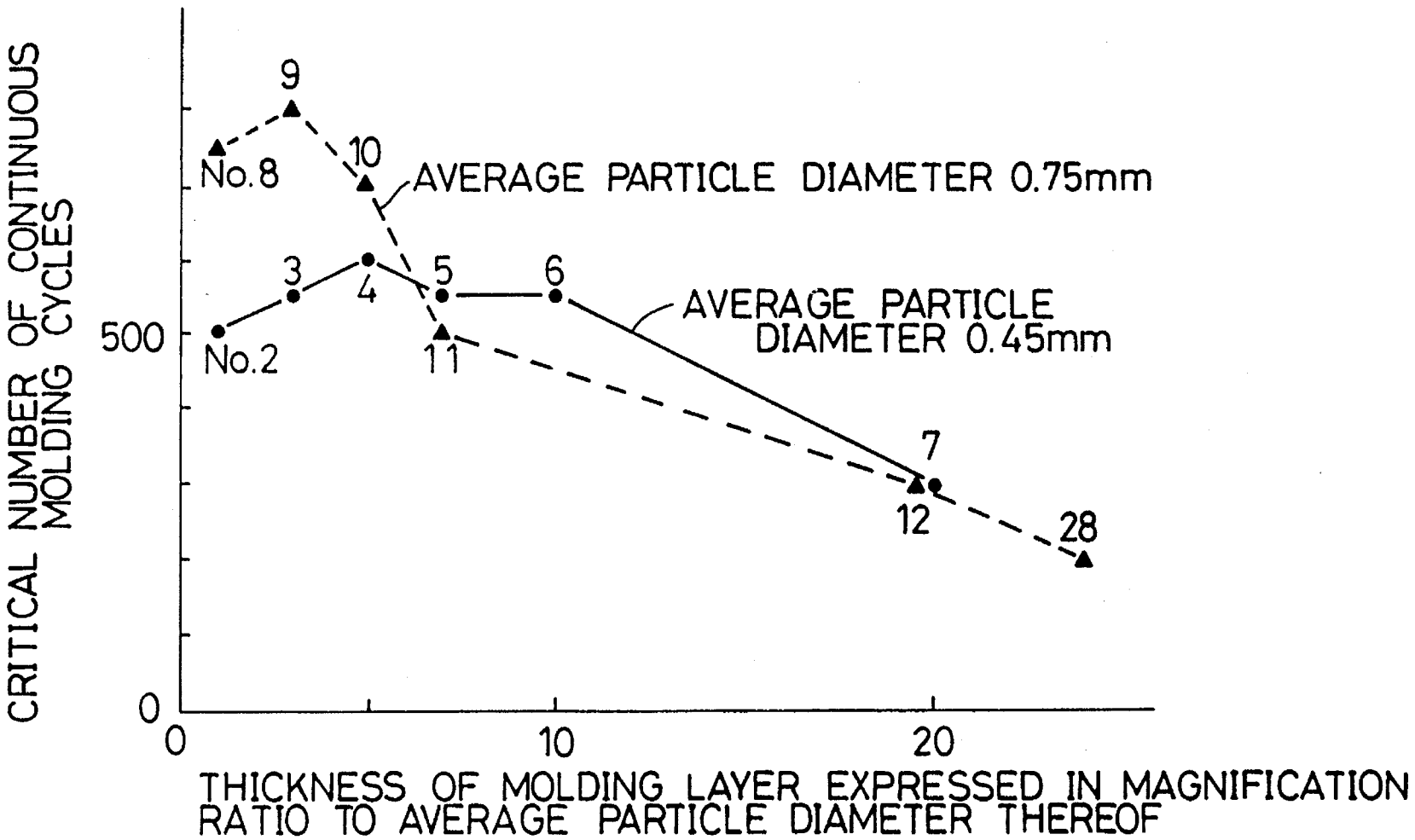
FIG. 12 is a graphic chart showing the critical number of continuous moldings depending on the thickness of the molding layer expressed in magnification ratio to the average diameter thereof in Example 1.
Figure 13:
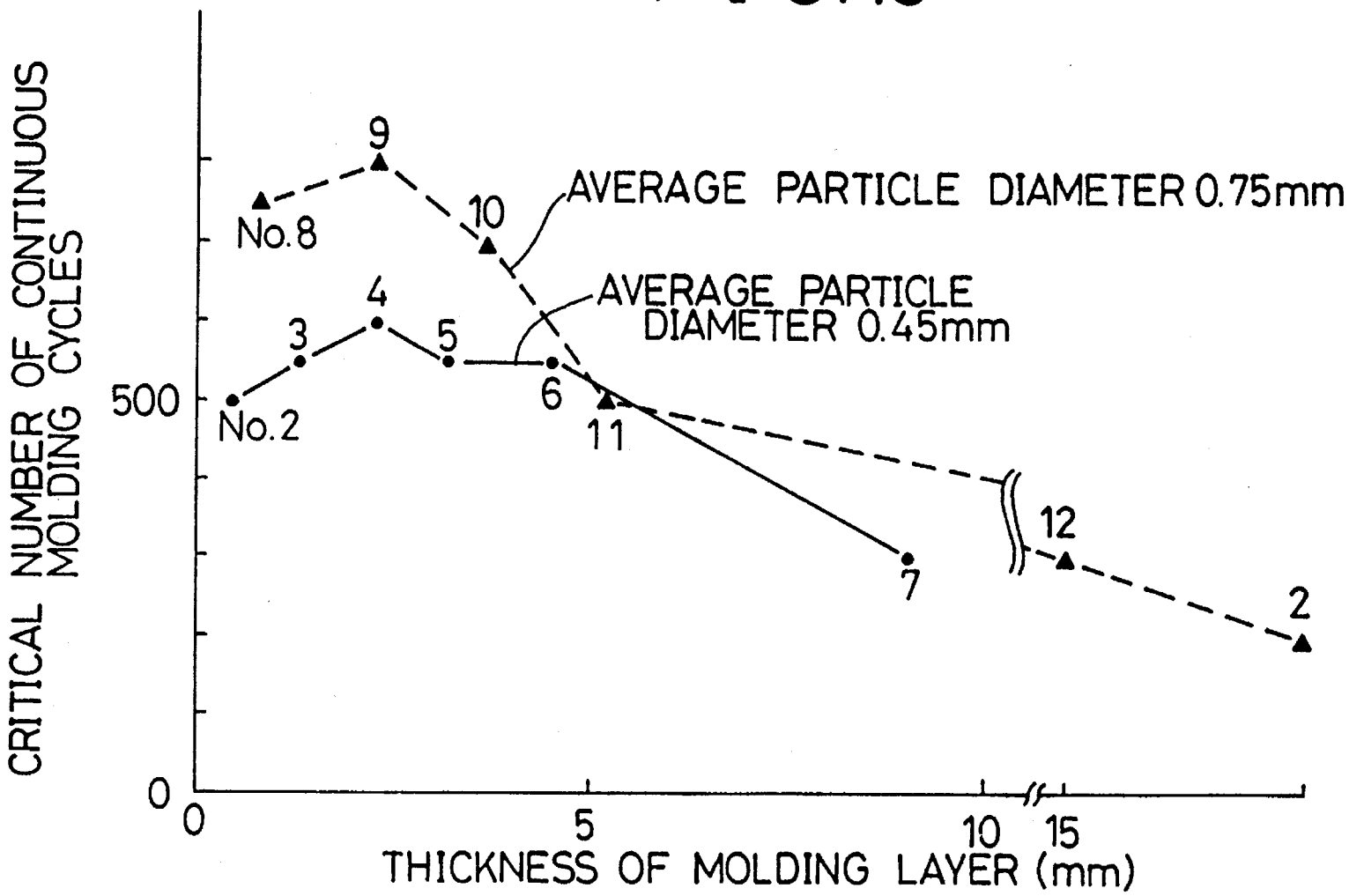
FIG. 13 is a graphic chart showing the critical number of continuous moldings depending on the thickness of the molding layer of the mold in Example 1.
Figure 14:
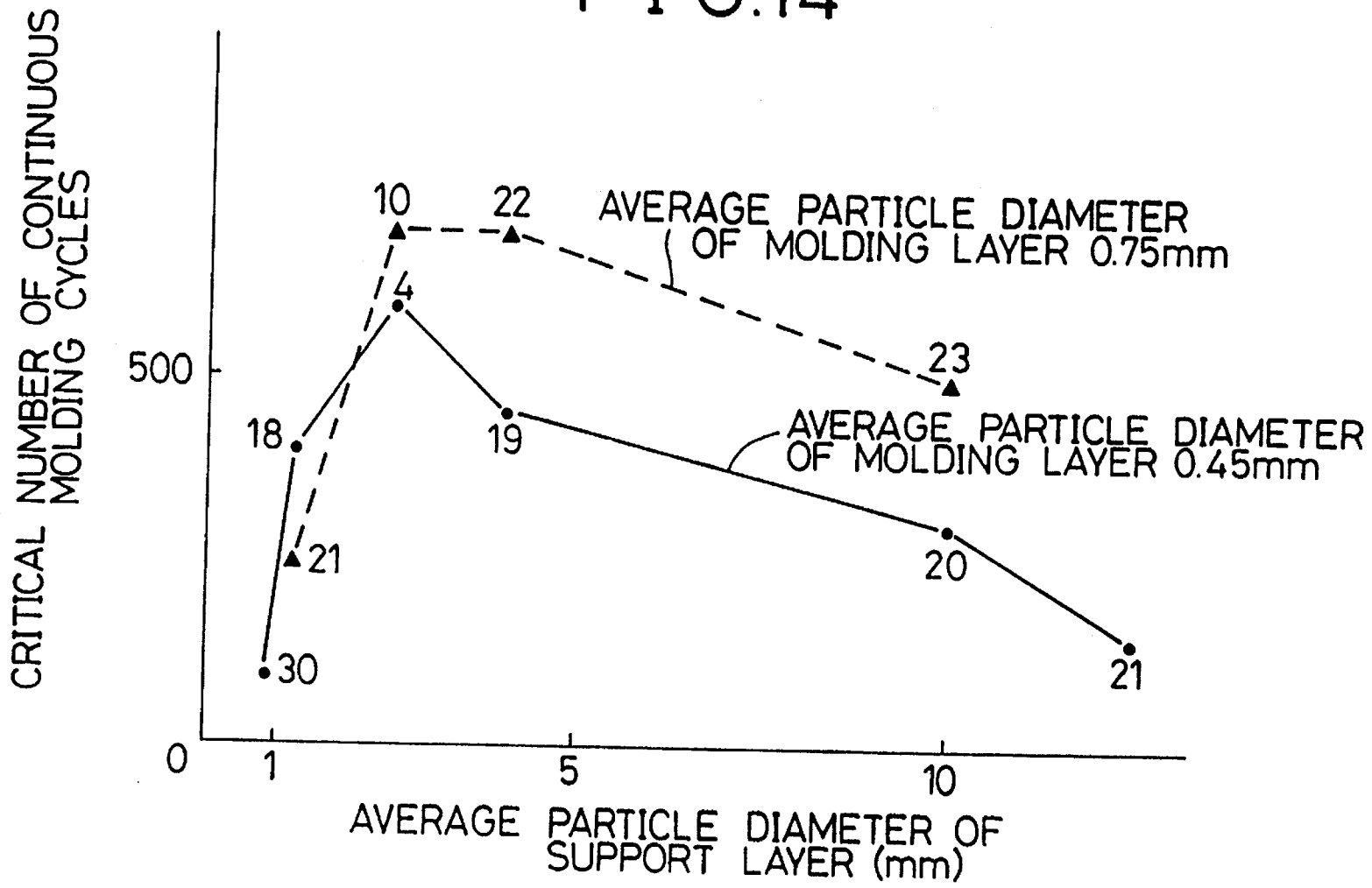
FIG. 14 is a graphic chart showing the critical number of continuous moldings depending on the average particle size of the support layer of the mold in Example 1.
Figure 15:
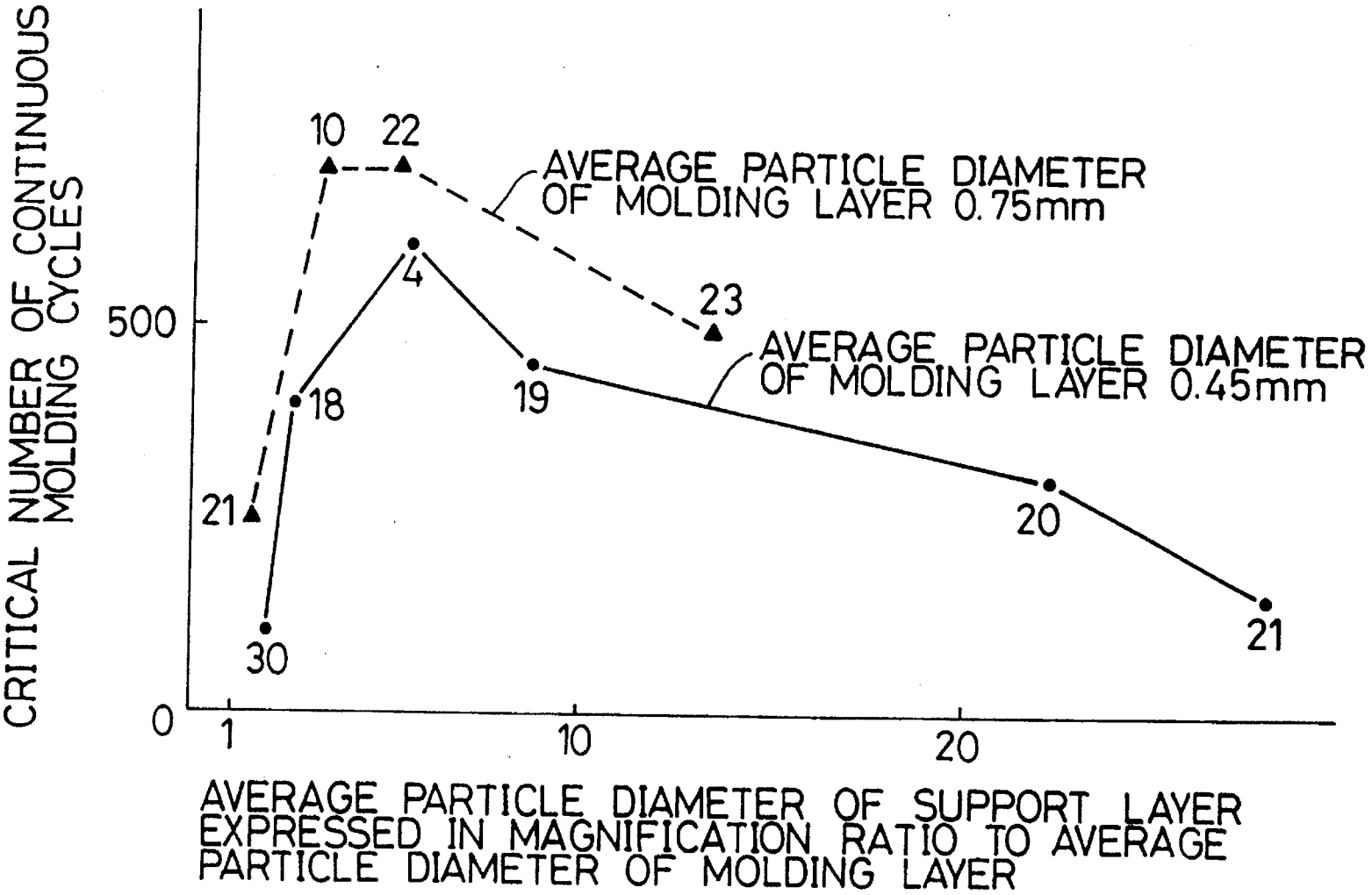
FIG. 15 is a graphic chart showing the critical number of continuous moldings depending on the average particle diameter of the support layer expressed in magnification ratio to the average particle diameter of the molding layer in Example 1.
Figure 16:
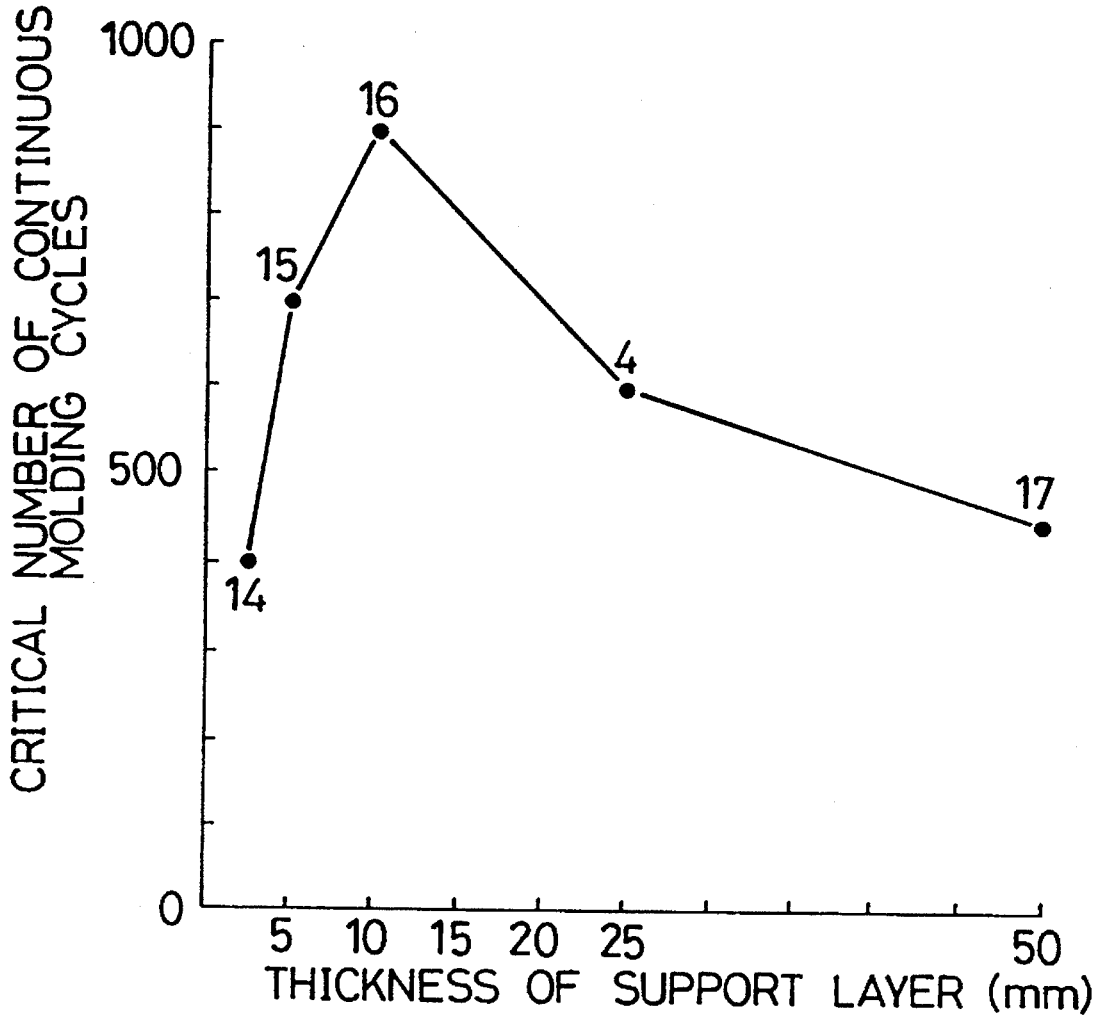
FIG. 16 is a graphic chart showing the critical number of continuous moldings depending on the thickness of the support layer of the mold in Example 1.

Particles in a bulk shape can be used. However, it is desirable that the shape of the particles is close to a perfect sphere so that the variance of space formed between the particles in the molding layer can be easily reduced. The desired properties can also be obtained by particles in a flat oval shape as shown in FIG.10 and preferably smooth shape in which the ratio of the long diameter L to the short diameter b is $L/b<2.0$ and ratio of the short diameter b to the thickness t is $b/t<2.0$. With such particles, uniform voids can be formed. Even If the ratio of the long diameter L to the short diameter b is 2.0≦L/b, the desired properties can be obtained by disposing the particles in the same direction parallel to the passage of water.

The particle diameter is specified to 0.2–1.0 mm, preferably 0.4–0.9 mm, more preferably 0.6–0.8 mm. When the particles are smaller than 0.2 mm in diameter, the voids formed between each particle are so small that the necessary permeability cannot be obtained and the productivity in molding deteriorates. When the particles are larger than 1.0 mm in diameter, the space formed between each particle is so wide that fibers enter the mold, resulting in protuberant roughness on the surface of the obtained fiber bodies, facilitating clogging as well as increasing difficulty in the separation of the fiber bodies from the mold. The problem of protuberant roughness on the surface of the molded fiber body is prominent in conventional wire mesh-type molds.

The particles forming the molding layer 1 have relatively uniform size of a particle diameter. The variance of the particle size regarding 80% of the particles in the layer 1 is preferably kept within ±0.2 mm of the average diameter of particles, more preferably kept within ±0.15 mm of the average diameter of particles. When the range of the variety in size falls wide of the range described above, the size of each void formed between the particles varies, causing the uniformity of pulp molding to be low, and excellent fiber bodies cannot be obtained.

The thickness of the molding layer 1 needs to be 1–20 times larger than the average diameter size of the particles forming the molding layer 1. The thickness of the layer needs to be at least the same as the average diameter size of the particles forming the molding layer 1 to prevent the obtained fiber bodies from having a rough surface. When the thickness of the layer is larger than 20 times the average diameter size of the particles in the molding layer, clogging is easily caused and washing by a counter flow of the present invention cannot be performed effectively. More specifically, the thickness of the molding layer 1 is 0.2–20 mm, preferably 0.2–10 mm, more preferably at least 0.2 mm and less than 5 mm.

Figure 5:
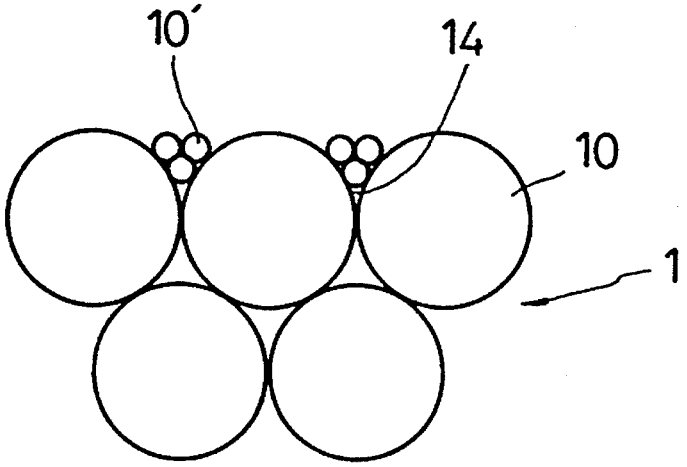
FIG. 5 is an explanatory view showing an example of structure of a molding layer of the present invention.

In the present invention, as shown in FIG. 5, it is preferable to fill particles 10' having an average diameter of at least 0.2 mm and at most ½ of the average diameter size of the particles in the molding layer in the concavity 14 of particles 10 forming the molding layer 1 in order to obtain molded fiber bodies having a cleaner, smoother surface and enhance the property of clogging resistance .

The particles are bonded by a resin bonding agent such as epoxy resin. A bonding agent is not limited to epoxy resin. According to the quality of particles, various kinds of thermoserring resins such as urethane resin, melamine resin, phenol resin, and alkyd resin; various kinds of metal solders, such as copper solder, silver solder, and nickel solder; various kinds of pewter; frit; thermoplastic resins; or the like can be used as the bonding agent. It is also possible to bond particles by other means such as sintering without any bonding agent. The mixture ratio of the resin bonding agent to particles is preferably 3–15% by volume. When the ratio is lower than 3%, the bonding strength may not be sufficient, resulting in inceased possibility of damage. When the ratio is higher than 15%, enough space may not be formed between the particles, and the permeability becomes lower, causing deterioration of the productivity.

The support layer 2, positioned on the inner surface of the molding layer 1, has enough permeability and ventilation by bonding particles having an average diameter of 1.0–10.0 mm and larger than the average diameter of the particles in the molding layer 1 to form the support layer to be at least as thick as the average diameter size of the particles used In the support layer 2.

It is necessary for the particles of the support layer 2 to have a diameter of at least 1 mm so as to obtain the effect of washing the mold. When the method of the present invention is applied, high effect of washing by a counter flow can be obtained by using particles in the layer 2 preferably having a diameter 1.5–10 times larger than the average diameter of the particles in the layer 1, more preferably 2–5 times. When the average diameter size of the particles in the layer 2 is smaller than 1.5 times, a sufficient washing effect cannot be obtained. When the average diameter size of the particles in the layer 2 is larger than 10 times, particles in the molding layer 1 are sucked into the support layer 2, which easily cause clogging. The average diameter size of the particles to be used in the support layer 2 is 1.0–10.0 mm, preferably 2.0–5.0 mm.

Considering the bonding strength between the layer 1 and the layer 2 and the deterioration of permeability when particles of layer 1 are sucked into the layer 2, it is preferable that the particles in the layer 2 in the part adjacent to the layer 1 have a diameter of at most 5 mm. When the particles in this part have a diameter larger than 5 mm, the mold has sufficient strength by having the structure that particles in the layer 1 are sucked In the layer 2. However, such a structure Is prone to cause clogging. It is also necessary that the average diameter of particles in the layer 2 is the same as or smaller than 10 mm to ensure the bonding strength of the support layer 2 when the layer 2 Is formed to be integrated by the rigid body 3 having apertures so as to back up the support layer 2. The mixture ratio of a resin bonding agent In the layer 2 Is preferably 3–15% by volume, which is the same as the ratio for the layer 1.

The support layer 2 is formed to have a thickness of at least the average diameter size of the particles in layer 2, preferably 2–10 times as thick as the average diameter size. When the support layer 2 is thinner than the average diameter size of the particles in the layer 2, the surface strength of the mold cannot be ensured. Moreover, when the support layer is backed up by the rigid body 3 having apertures to ensure the surface strength of the mold not having thickness of at least 2 times, difference in washing pressure applied to the molding layer 1 by a counter flow is caused between the parts corresponding to apertures and the parts not corresponding to apertures, resulting in clogging. Therefore the thickness of the support layer should be at least twice the average diameter size of the particles in the support layer 2. When the support layer 2 is thicker than 10 times the average diameter size of the particles in the support layer 2, the pressure applied to the molding surface upon washing by a counter flow is not enough, causing clogging. In view of pressure loss resulting from layer 2, it is preferable to make the layer 2 thin, more preferably, 3–7 times the average diameter size of particles in the layer 2. However, even if the layer 2 should, for example, measure about 10 times, the mold can be washed Just as effectively as when the thickness if 3–7 times, if the pressure from the inside is increased and apertures are added.

In the present invention, it is preferable in view of effective washing that the molding layer 1 and/or the support layer 2 are/is constituted so that pores are mutually linked with each other so as to have water-retaining property by capillarity.

Figure 2:
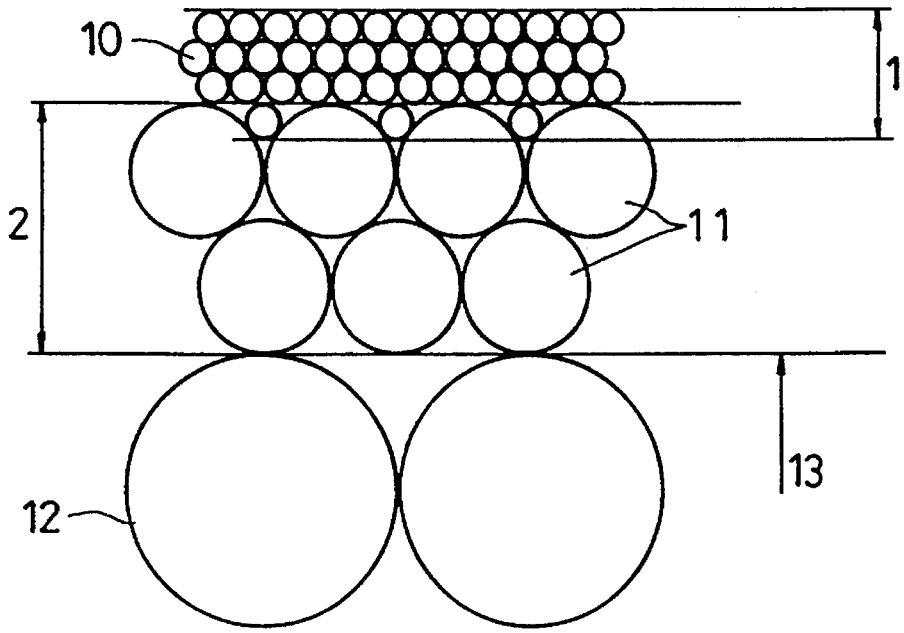
FIG. 2 is an explanatory view showing an example of disposition of a molding layer and a support layer of the present invention.
Figure 3:
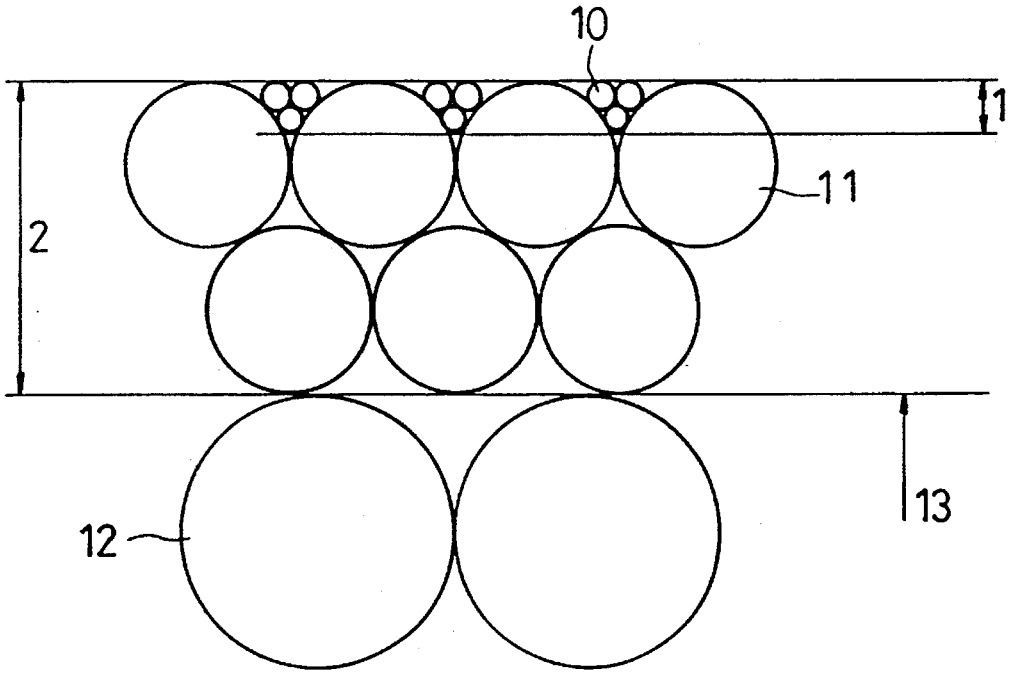
FIG. 3 is an explanatory view showing an example of disposition of a molding layer and a support layer of the present invention.
Figure 4:
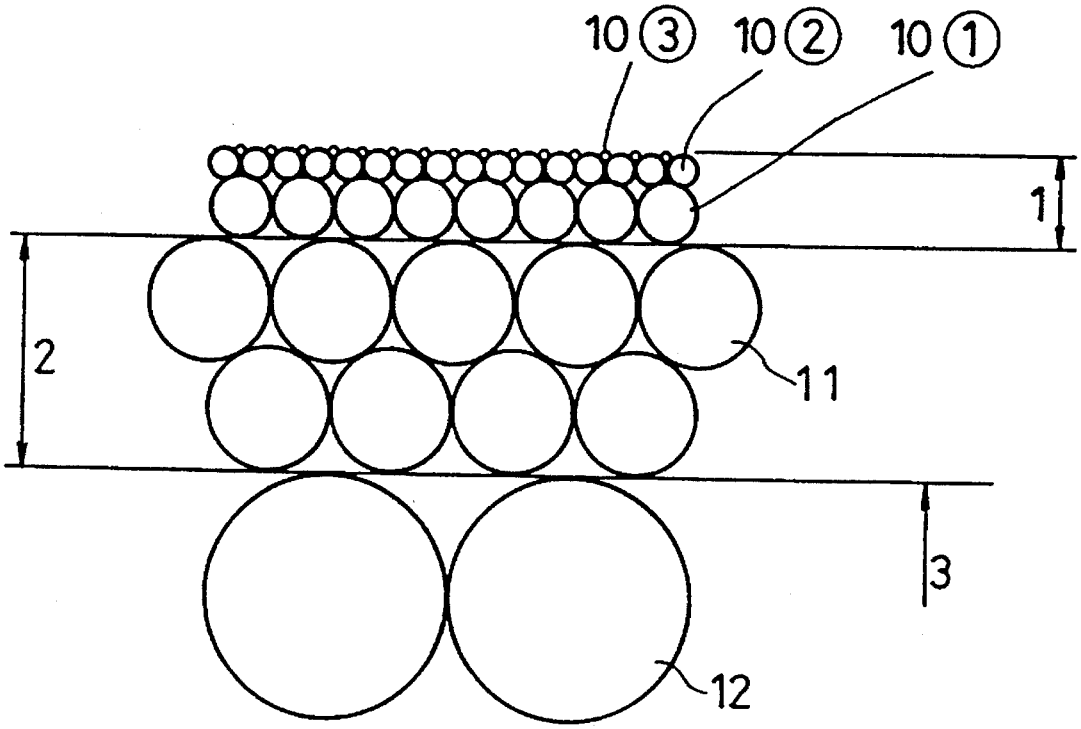
FIG. 4 is an explanatory view showing an example of disposition of a molding layer and a support layer of the present invention.

As described above, the pulp mold of the present invention has a structure comprising a molding layer 1 and a support layer 2. Typical dispositions of the layers 1 and 2 are shown in FIG. 2–4. FIG. 2 shows a mold having a molding layer 1 formed by bonding small particles 10 to have a desired thickness, a support layer 2 formed by bonding larger particles 11 than particles 10 to have a desired thickness and positioned on the inner surface of the layer 1, and a back-up layer 13 formed by bonding larger particles 12 than particles 11 in order to back up the support layer 2. FIG. 3 shows a mold having a thin molding layer 1 and the surface of the support layer 2 is partially exposed on the surface of the mold. FIG. 4 shows a mold having a molding layer 1 formed by particles 10 having one of three kinds of diameters within the range proposed by the present invention so that particles 10 ③ having the smallest diameter are placed in the side of molding surface, particles 10 ① having the largest diameter are placed in the side adjacent to the support layer 2, and particles 10 ② having the second largest diameter are placed between the layers of particles 10 ③ and 10 ③. Such a mold shown in FIG. 4 may be used. The desired effect can be obtained when the variance of the particle size in the parallel direction to the layers is small.

The support layer 2 is integrally formed with a rigid body 3. The rigid body 3 can be made from any kind of materials, such as metal or plastic, which can maintain a given strength to back up the support layer 2. It is also possible to use a back-up layer, as a rigid body 3, formed by bonding particles such as glass beads having a larger particle diameter than particles in the support layer 2. When a metal, for example, aluminum alloy is used, the thickness is preferably at least 5 mm, more preferably 10–20 mm. The rigid body has numerous apertures 4. When the thickness of rigid body 3 is less than 5 mm, the rigidity of the body deteriorates and tile layer 2 is prone to be damaged by distortion caused by repeated loads upon producing fiber bodies. Aluminum, which Young's modulus is about 7000 kgf/mm$^2$, has far higher rigidity compared with a resin bonding material, which Young's modulus is 1000 kgf/mm$^2$. Therefore, it is preferable to use a metal for the rigid body. By replenishing particles used in the support layer 2 in the apertures 4 of the rigid body, the bonding strength can be enhanced. It is possible that the rigid body has a structure having ribs to obtain both light weight and strength.

When the area of the molding surface is small and the stress by atmospheric pressure is small during producing fiber bodies by suction, or when the number of the fiber bodies to be formed is small, the strength of the mold can be ensured by increasing the thickness of the layer 2, and the box-shaped rigid body can be used only in the peripheral part of the mold and at the joint with chamber 5, the peripheral part being easily pressurized.

When a box-shaped rigid body 3 is adopted, a change in the shape of the molding surface need only include a change in the shapes of the molding layer 1 and the support layer 2 which use the same kind of frame. It makes the production of the pulp mold easy, and the modification of tile shape of the mold is possible. Therefore, the mold can be produced at low cost. Further, in this type of pulp mold, clogging can be eliminated easily by stopping the operation and washing the mold by pressurized water in the same way as the conventional method.

Figure 6:
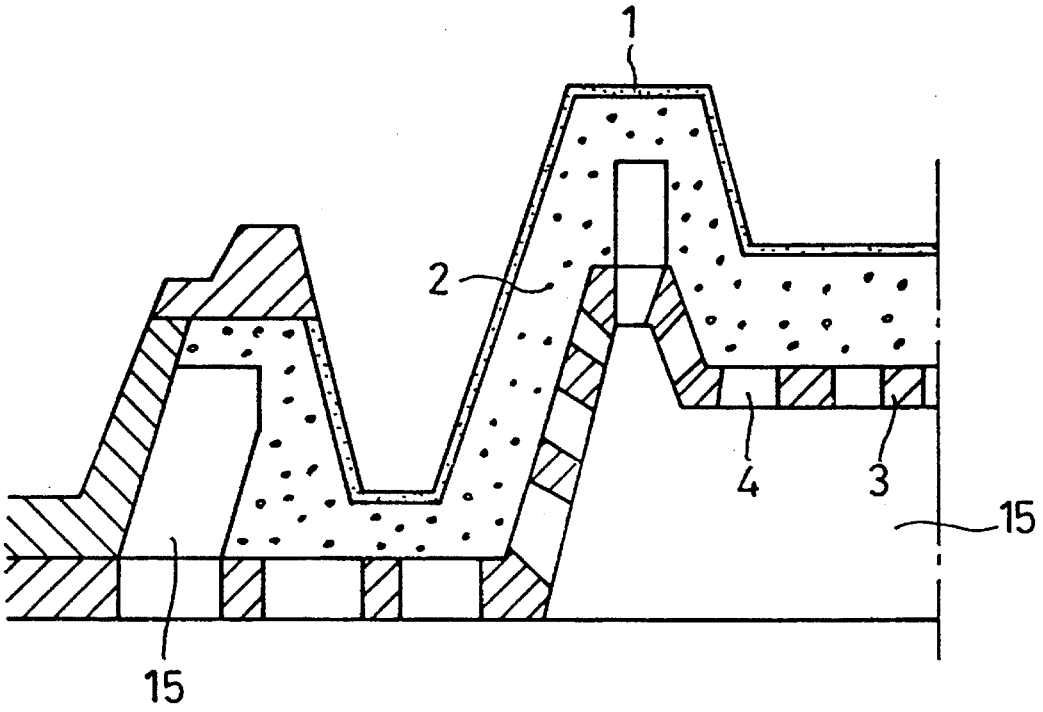
FIG. 6 is a sectional view showing an example of structure that a molding layer and a support layer are formed to be integrated by a rigid body.
Figure 7:
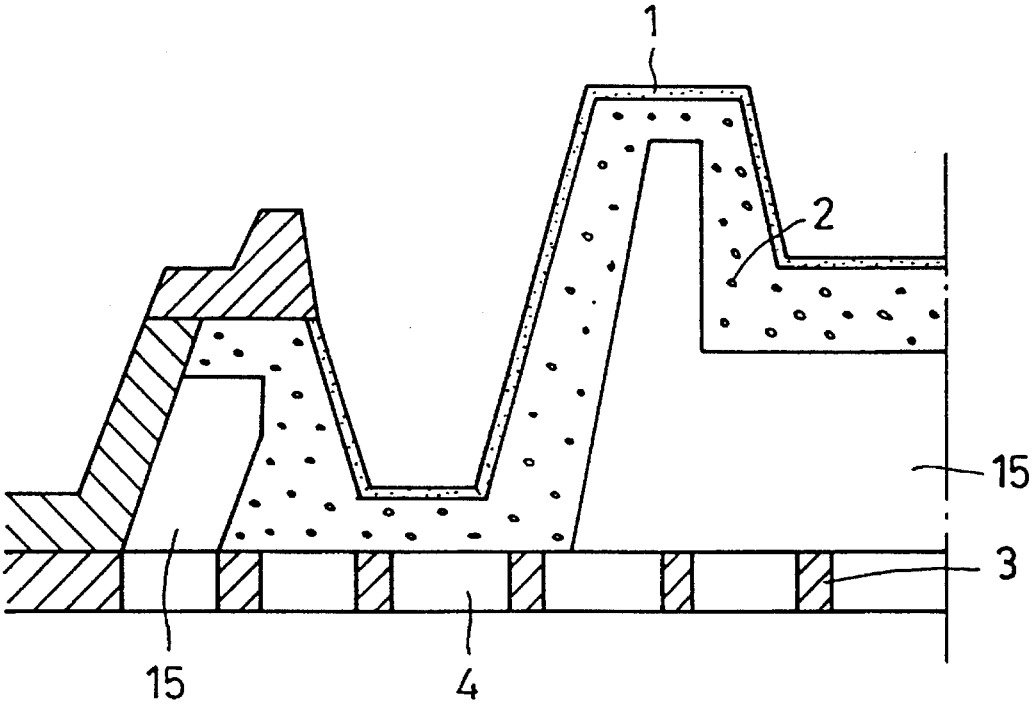
FIG. 7 is a sectional view showing an example of structure that a molding layer and a support layer are formed to be integrated by a rigid body.
Figure 8:
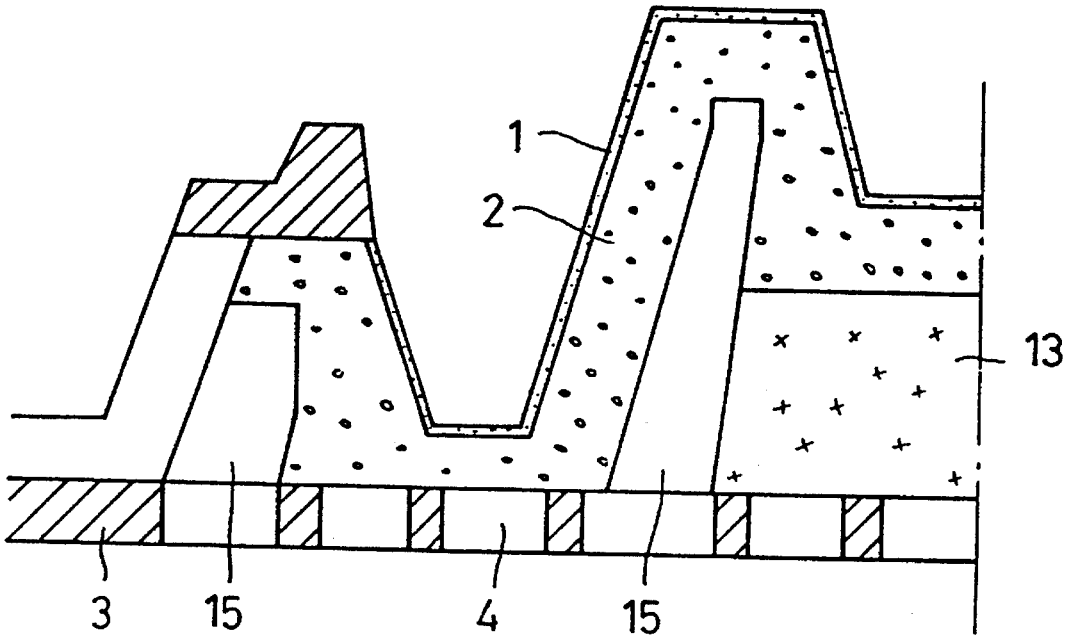
FIG. 8 is a sectional view showing an example of structure that a molding layer and a support layer are formed to be integrated by a rigid body.
Figure 9:
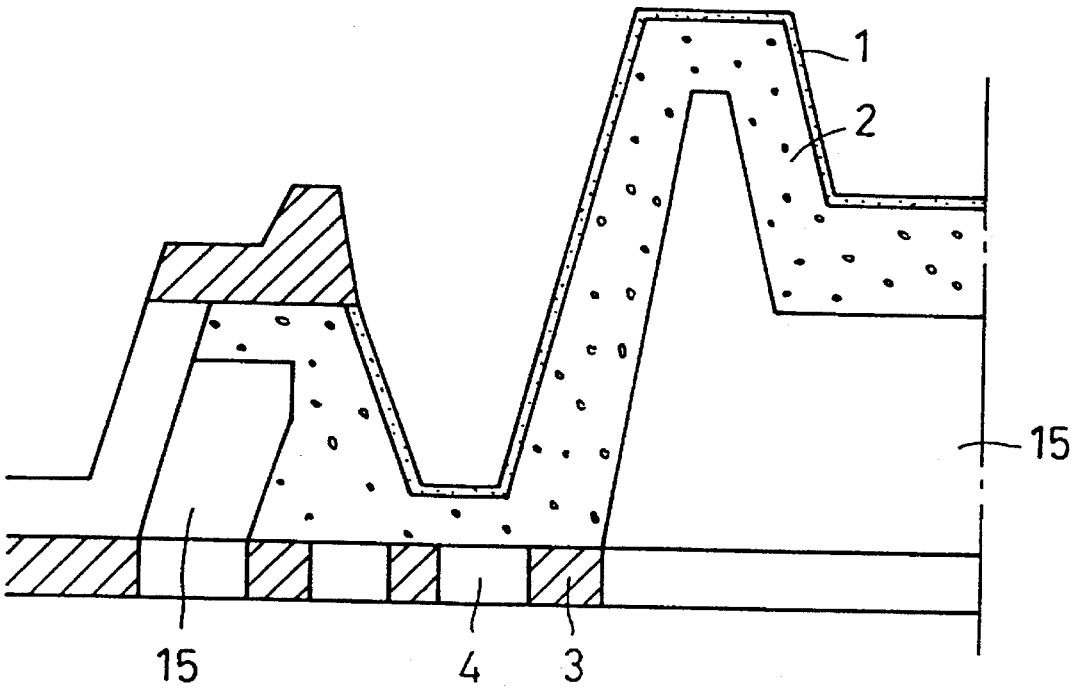
FIG. 9 is a sectional view showing an example of structure that a molding layer and a support layer are formed to be integrated by a rigid body.

FIGS. 6–9 show examples of the structures forming the molding layer 1 and the support layer 2 to be integrated by tile rigid body 3. FIG. 6 shows a structure that a support layer 2 is maintained by a rigid body 3 adhered to the support layer 2 from below. FIG. 7 shows a structure that a flat rigid body 3 does not contact to a support layer 2 at the center of the support layer 2. FIG. 8 shows a structure that a back-up layer 13 is inserted between the support layer 2 and the rigid body 3 of the mold shown in FIG. 7. FIG. 9 shows a structure that the center of the rigid body 3 of the mold shown in FIG. 7 is removed. Reference numeral 15 is a hollow.

Now, the method of producing fiber bodies of the present invention is hereinafter described.

According to tile method for producing fiber bodies of the present invention, a backwashing process is added. The process is that the molding layer 1 or the support layer 2, preferably the molding layer 1 and the support layer 2 are soaked with water after the step of producing a fiber body, followed by pressurizing by compressed air inside the mold. By this process, water and air pass though the support layer and the molding layer and fiber, stuck on the molding layer during producing fiber bodies, is blown away outside of the mold. As the molding layer 1 and/or the support layer 2 have a structure which includes appropriate space ranges, water is well retained, and as a result, backwashing can be very effectively performed. When the diameter of the particles in the molding layer 1 is smaller than the given size, it causes difficulty in water-permeance. On the contrary, when the diameter of the particles in the molding layer 1 is larger than the given size, it causes non-uniformity of water-retainment and a sufficient effect of backwashing cannot be obtained.

More specifically, a method of the present invention preferably includes the washing process in which compressed air is emitted from inside the mold after uniformly soaking the molding layer 1 or the support layer 2, or both the molding layer 1 and the support layer 2 with water. The condition that water and air can pass at least the molding layer 1 makes the backwashing very effective. It is preferable that pressure higher than atmosphere pressure is impulsively applied to the inside of the mold in order to enhance the washing effect. The pressure is applied so as to have the maximum emitting pressure of at least 1.0 gf/cm$^2$ on the molding surface, more preferably at least 3.0 gf/cm$^2$. Considering the effect of washing by a counter flow, tile pressure on the molding surface is preferably high. However, the pressure of 500 gf/cm$^2$ or lower is practical in view of the size of the apparatus and the cost. An impulsive pressurization for backwashing is effective, and it is preferable that pressure increase of at least 1.0 gf/cm$^2$ is obtained within 0.5 seconds.

It is very effective to apply pressure more than once, i.e. to pulse it. This operation can be easily controlled by instantaneously opening the pressurizing valve 9 for backwashing, maintaining the pressure of at least several atm. in the pressurizing chamber 17. Because of impulsive pressurizing it is preferable that the pressuring valve 9 for backwashing has a large capacity, that the pressuring chamber 17 also has a sufficient capacity as compared to the capacity of chamber 5, and that a caliber of the tube 6 is as large as possible. A method in which washing is performed only by emitting air from inside the mold does not give sufficient result of washing, and another method in which water pressure is applied from inside the mold has high risk of damaging because the pressure applied to the molding layer 1 or the support layer 2 becomes too high. Therefore, it is preferable that pressurized water is applied to tile molding surface from outside of the mold. Washing can be more effective by adding a surface active agent to tile washing water.

Washing by a counter flow in accordance with the present invention can be performed in an interval (several seconds) of between two moldings. Therefore, it does not increase the time of the molding cycle, and the effect of washing is greater than that of the conventional washing method. It is most effective that the washing is performed in every Interval between molding. However, it is possible to perform washing once in 5–10 moldings when the shape of the mold is simple or when the number of moldings is small.

By adopting the method having the washing process mentioned above, the mold can be prevented from clogging without decreasing its productivity. Particularly, by using the mold of the present invention and adopting the method of the present invention, an excellent effect of washing can be obtained, and at least thousands of continuous moldings without clogging become possible. Moreover, even if clogging is caused, the mold can be easily washed by a conventional method in which the molding surface of the mold is sprayed with pressurized water.

The present invention is hereinafter described in more detail with reference to Examples. However, the present invention is not limited to these Examples.

Example 1, Comparative Example 2

Continuous pulp-molding was performed with a molding cycle of 20 seconds under the condition shown in Table 1 (Example No. 1–26) and Table 2 (Comparative Example No. 27–35) on the basis of the processes shown in Table 3. Productivity was evaluated by the critical number of continuous pulp moldings until unevenness in the surface of the molding was caused by clogging of the mold.

The intended thickness of the fiber bodies to be molded was 2 mm. After every ten moldings up to 100 moldings and after every 50 moldings over 100 moldings, the thickness of the molded fiber bodies was checked. The productivity was evaluated by the critical number of continuous moldings until the thickness of any part of the molded body becomes 0.5 mm or less. The molding surface had some parts in which some letters were engraved, and the transcription was also evaluated regarding clearness of the letters on the surface of the molded bodies.

The fiber slurry was prepared by mixing fiber pulp obtained from newspaper and card board in a proportion of 1:1 by weight and dispersing the pulp in water so as to have a density of 1% by weight.

The basic structure of the pulp mold is as follows, with reference to FIG. 1.

The metal frame 3, which is made of 10mm-thick aluminum alloy, has apertures 4 of 20×20mm. The frame 3 is adhered closely to the chamber 5 with bolt(s) which is(are) not indicated in the drawing. The pressure in the vacuum chamber 16 is reduced to 60mmHg or lower by a vacuum pump. The pressure in the pressurizing chamber 17 is maintained so as to be 1 atm. by a pressurizing pump. A shower 18 is also set so that the molding surface of the pulp mold is sprayed with water after each molding.

Both the molding layer 1 and the support layer 2 are formed by bonding glass beads by mixing a water-insoluble epoxy resin at 4% by volume. The size of the pulp mold is 200 mm×200 mm In a square shape. The mold has a convexity "a" of 50 mm. The diameter size of 80% of the particles in the molding layer i is adjusted to be within ±0.15 mm of an average diameter of particles in that layer, except for Nos. 24 and 25. The thickness of the molding layer 1 is prescribed as a minimum thickness of the molding layer 1 including the particles of the layer 1 sucked in layer 2.

In the support layer 2, particles having each particle size to be within ±30% of the average diameter size of particles in the support layer 2 are used. The particles of 10 mm and 12.5 mm in the layer 2 in Nos. 20, 23, and 31 are made of alumina. The standard thickness of the layer 2 is 25mm, and the thickness of the layer 2 in No. 17 is 50mm in maximum. In No. 14 and 15, the molds, having the shape of the rigid body corresponding to the shape of the molding surface and aiming at having the support layer 2 of 2.5 mm or 5 mm in thickness, are prepared. In No. 34, the mold has a structure that only a plate-shaped rigid body as in No. 15 and a molding layer are bonded. In No. 26 and 32, the molding layer 1 has a dual structure using particles of two kinds of diameters.

These molds were made by (1) preparing master models having a given shape of the molding surface ( concave resin molds ), (2) laminating a mixture of particles for the molding layer 1 and epoxy resin so as to have a given thickness, (3) laminating a mixture of particles for the molding layer 2 and epoxy resin, and (4) placing a rigid body 3. In this case, the molding layer 1, the surface layer 2, and a rigid body 3 were mutually connected by epoxy resin. Then, the molds were obtained by separating the molds from the master models. In the molds of Nos. 26 and 32, mixtures of epoxy resin and particles each having diameters of 0.3 mm and 0.15 mm respectively are filled on the surface of the molds separated from the master models.

As a conventional example, a conventional mold No. 35 made of aluminum alloy having a particular shape of the molding surface and having pores of about 5 mm at intervals of 10–20 mm on all tile molding surface and a 40-mesh wire net placed on all tile surface of the mold.

Regarding tile molds used in Nos. 1–13, 27, 28, 29, 34 and 35, the evaluation was first made of the number of continuous moldings until clogging was caused by the conventional method. Then, clogging was removed by simply washing tile surface of the mold by pressurized water (i.e., the conventional method of washing). Subsequently, the evaluation was made of the number of continuous moldings until clogging was caused by the method of the present invention. In the backwashing method of the present invention, a method in which opening and shutting the valves is performed only once, was adopted (i.e., the washing once/cycle method).

All the results are shown in Tables 1 and 2 and in FIGS. 11–16.

Transcription of the letters in fiber bodies formed by the pulp mold of the present invention was excellent.

TABLE 1-a

| | | | No. | | | | | | | | | | | | |
|---|---|---|---|---|---|---|---|---|---|---|---|---|---|---|---|
| | | | 1 | 2 | 3 | 4 | 5 | 6 | 7 | 8 | 9 | 10 | 11 | 12 | 13 |
| Molding Layer 1 | ① Average diameter of particles (mm) | | 0.2 | 0.45 | 0.45 | 0.45 | 0.45 | 0.45 | 0.45 | 0.75 | 0.75 | 0.75 | 0.75 | 0.75 | 0.9 |
| | ② Thickness | ②/① | 5 | 1 | 3 | 5 | 7 | 10 | 20 | 1 | 3 | 5 | 7 | 20 | 5 |
| | | mm | 1.0 | 0.45 | 1.35 | 2.25 | 3.15 | 4.5 | 9.0 | 0.75 | 2.25 | 3.75 | 5.25 | 15.0 | 4.5 |
| | Remarks | | | | | | | | | | | | | | |
| Support Layer 2 | ③ Average diameter of particles | mm | 2.5 | 2.5 | 2.5 | 2.5 | 2.5 | 2.5 | 2.5 | 2.5 | 2.5 | 2.5 | 2.5 | 2.5 | 2.5 |
| | | ③/① | 12.5 | 5.6 | 5.6 | 5.6 | 5.6 | 5.6 | 5.6 | 3.3 | 3.3 | 3.3 | 3.3 | 3.3 | 2.8 |
| | ④ Thickness | mm | 25 | 25 | 25 | 25 | 25 | 25 | 25 | 25 | 25 | 25 | 25 | 25 | 25 |
| | | ④/③ | 10 | 10 | 10 | 10 | 10 | 10 | 10 | 10 | 10 | 10 | 10 | 10 | 10 |
| | Remarks | | | | | | | | | | | | | | |
| Critical Number | Conventional Method | | 50 | 70 | 90 | 100 | 90 | 80 | 70 | 90 | 100 | 90 | 90 | 70 | 90 |
| | Washing once/cycle | | 250 | 500 | 550 | 600 | 550 | 550 | 300 | 750 | 800 | 700 | 500 | 300 | 650 |
| | Remarks | | | | | | | | | | | | | | |

TABLE 1-b

| | | | No. | | | | | | | | | | | | |
|---|---|---|---|---|---|---|---|---|---|---|---|---|---|---|---|
| | | | 14 | 15 | 16 | 17 | 18 | 19 | 20 | 21 | 22 | 23 | 24 | 25 | 26 |
| Molding Layer 1 | ① Average diameter of particles (mm) | | 0.45 | 0.45 | 0.45 | 0.45 | 0.45 | 0.45 | 0.45 | 0.75 | 0.75 | 0.75 | 0.75 | 0.75 | 0.75 |
| | ② Thickness | ②/① | 5 | 5 | 5 | 5 | 5 | 5 | 5 | 5 | 5 | 5 | 5 | 5 | 5 |
| | | mm | 2.25 | 2.25 | 2.25 | 2.25 | 3.75 | 3.75 | 3.75 | 3.75 | 3.75 | 3.75 | 3.75 | 3.75 | 3.75 |
| | Remarks | | | | | | | | | | | | (1) | (2) | (3) |
| Support Layer 2 | ③ Average diameter of particles | mm | 2.5 | 2.5 | 2.5 | 2.5 | 1.2 | 4 | 10 | 1.2 | 4 | 10 | 2.5 | 2.5 | 2.5 |
| | | ③/① | 16.7 | 16.7 | 16.7 | 16.7 | 2.6 | 8.8 | 22.2 | 1.6 | 5.3 | 13.3 | 3.3 | 3.3 | 3.3 |
| | ④ Thickness | mm | 2.5 | 5 | 10 | 50 | 25 | 25 | 25 | 25 | 25 | 25 | 25 | 25 | 25 |
| | | ④/③ | 1 | 2 | 4 | 20 | 20.8 | 6.3 | 2.5 | 20.8 | 0.3 | 2.5 | 10 | 10 | 10 |
| | Remarks | | (4) | | | | | | | | | | | | |
| Critical Number | Conventional Method | | — | — | — | — | — | — | — | — | — | — | — | — | — |
| | Washing once/cycle | | 400 | 700 | 900 | 450 | 400 | 450 | 300 | 250 | 700 | 600 | 600 | 400 | 850 |
| | Remarks | | *2 | | | | | | | | | | | | |

*2 Clogging observed in regions without apertures.
(1) 80% of the particles have the diameters within the range of ±0.2 mm from the average diameter.
(2) 60% of the particles have the diameters within the range of ±0.2 mm from the average diameter.
(3) The concaves on the surface were filled with particles having an average diameter of 0.3 mm.
(4) The support layer is backed up by a rigid body.

TABLE 2

| | | | No. | | | | | | | | |
|---|---|---|---|---|---|---|---|---|---|---|---|
| | | | 27 | 28 | 29 | 30 | 31 | 32 | 33 | 34 | 35 |
| Molding Layer 1 | ① Average diameter of particles (mm) | | 0.15 | 0.75 | 1.2 | 0.45 | 0.45 | 0.75 | 0.45 | 0.75 | (5) |
| | ② Thickness | ②/① | 5 | 24 | 5 | 5 | 5 | 5 | 5 | 10 | — |
| | | mm | 0.75 | 18.0 | 2.4 | 3.75 | 3.75 | 3.75 | 2.25 | 7.5 | — |
| | Remarks | | | | | | | (6) | (7) | (8) | |
| Support Layer 2 | ③ Average diameter of particles | mm | 2.5 | 2.5 | 2.5 | 0.9 | 12.5 | 2.5 | 2.5 | — | (8) |
| | | ③/① | 16.7 | 3.3 | 2.1 | 2.0 | 27.8 | 3.3 | 16.7 | — | (9) |
| | ④ Thickness | mm | 25 | 25 | 25 | 25 | 25 | 25 | 5 | — | — |
| | | ④/③ | 10 | 10 | 10 | 27.8 | 2.0 | 10 | 2.0 | — | — |
| | Remarks | | | | | | | | | | |

TABLE 2-continued

| | | No. | | | | | | | | |
|---|---|---|---|---|---|---|---|---|---|---|
| | | 27 | 28 | 29 | 30 | 31 | 32 | 33 | 34 | 35 |
| Critical Number | Conventional Method | 30 | 60 | 40 | — | — | — | — | 40 | 90 |
| | Washing once/cycle | 150 | 200 | 250 | 100 | 150 | 150 | 350 | 150 | 150 |
| | Remarks | *1 | | *3 | | *5 | | *4 | | *6 |

*1 Fiber bodies less than 2 mm thick - listed only for reference.
*3 Roughness on the surface and unclearness of the letters on the surface of fiber bodies.
*4 Damaging on the mold at 350th molding because of thinness of the molding layer and the support layer. - Discontinuation of molding.
*5 Partial exfoliation of the molding layer - Discontinuation of molding.
*6 Transcription of shape of a joint and a wire not of the mold to the surface of fiber bodies, and unclear transcription of the corner shape of letters.
(5) #40 wire net
(6) The concave is filled with particles having an average diameter of 0.15 mm.
(7) A rigid body was not used.
(8) Backed up by a rigid body.
(9) The support layer made of aluminum alloy having apertures is used.

TABLE 3

| Molding Processes Used in Examples (Conventional method excludes 7 and 8.) | Time |
|---|---|
| 1. Immerse a pulp mold into pulp slurry. | 1 second |
| 2. Open the decompression valve. | 1 second in slurry |
| 3. Take the mold out of the slurry, and reduce the water in the fiber body by suction. | 13 seconds |
| 4. Shut the decompression valve. | |
| 5. Separate the fiber body from the mold (by pressuring from inside the mold by opening the pressurizing valve for separating a molded fiber body). | 2 seconds |
| 6. Spray water on the molding surface. | 1 second in the method of the present invention, 3 seconds in the conventional method |
| 7. Open the pressurizing valve for backwashing. [Open and Shut Once] [3 times/2 seconds (Example 3)] | 2 seconds |
| 8. Shut the pressurizing valve for backwashing. | |
| 9. Return to No. 1 | |

The above results show that the pulp mold of the present invention gloves fiber bodies which have the property of clogging resistance to the same extent as the conventional mold using a wire net and which have a smooth surface without any joint as is formed by molding by the conventional method. Further, by applying the method of the present invention to the molding, the effect to prevent the mold from clogging is enhanced, and continuous molding of more than hundreds of cycles, or continuous molding of nearly a thousand cycles by the mold having the proper combination of the molding layer and the surface layer, is made possible. In contrast, the moldings performed without using the mold or method of the present invention have problems such as difficulty in long continuous molding, producing fiber bodies having bad-looking surfaces, or damaging of the mold.

Example 2

Figure 17:
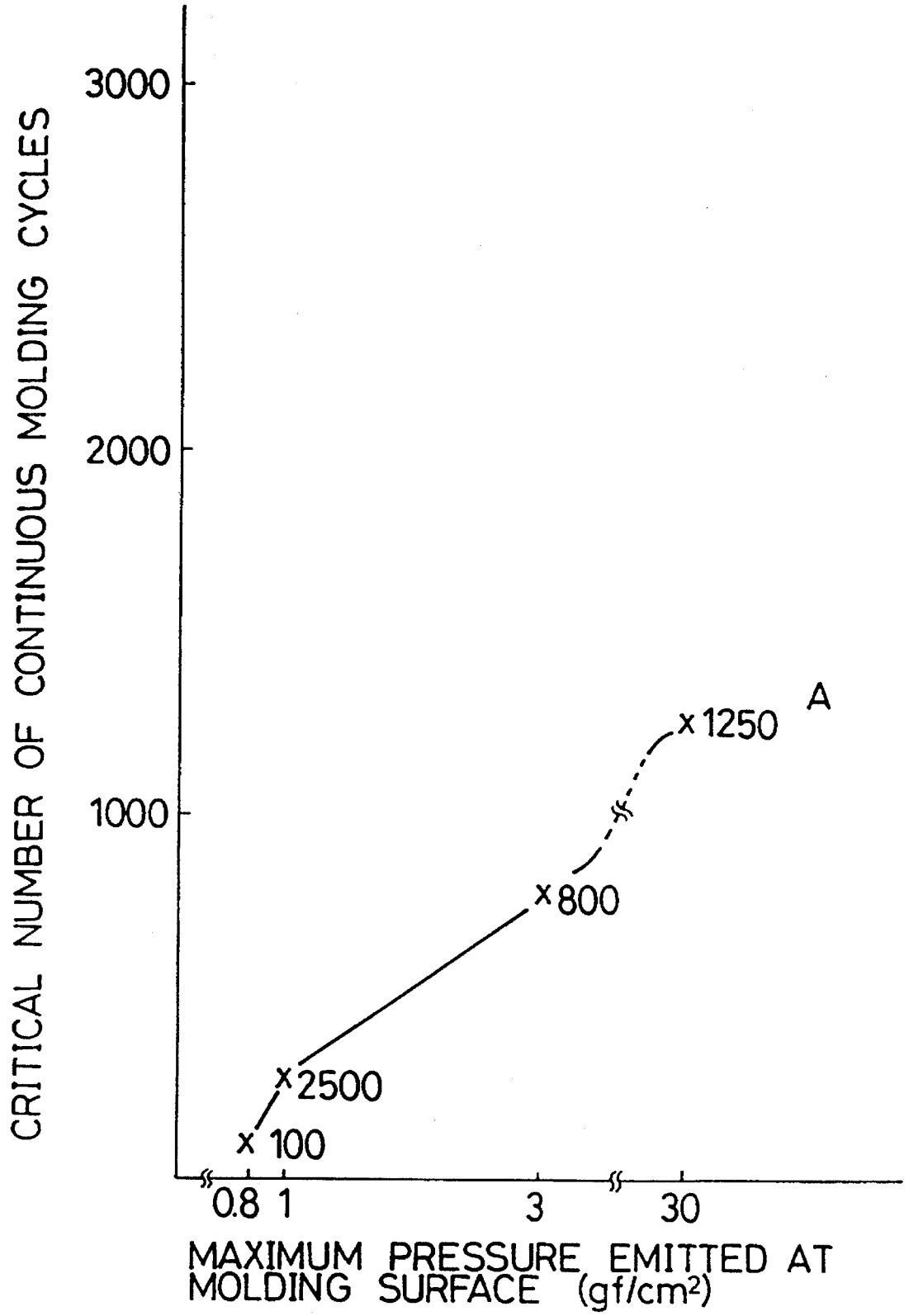
FIG. 17 is a graphic chart showing the result of Example 2.

The pressure emitted was measured at the surface of a pulp mold A having the same structure as the mold in Example 1 except that the molding layer 1 is formed by bonding glass beads having an average diameter of 0.75 mm to have a thickness of 3.75 mm and that the support layer 2 is formed by bonding glass beads having an average diameter of 2.5 mm to have a thickness of 10.0 mm. The critical number of continuous moldings was evaluated, while adjusting the maximum pressure emitted the surface by changing the pressure in the pressurizing chamber. The result is shown In FIG. 17.

Example 3

Figure 18:
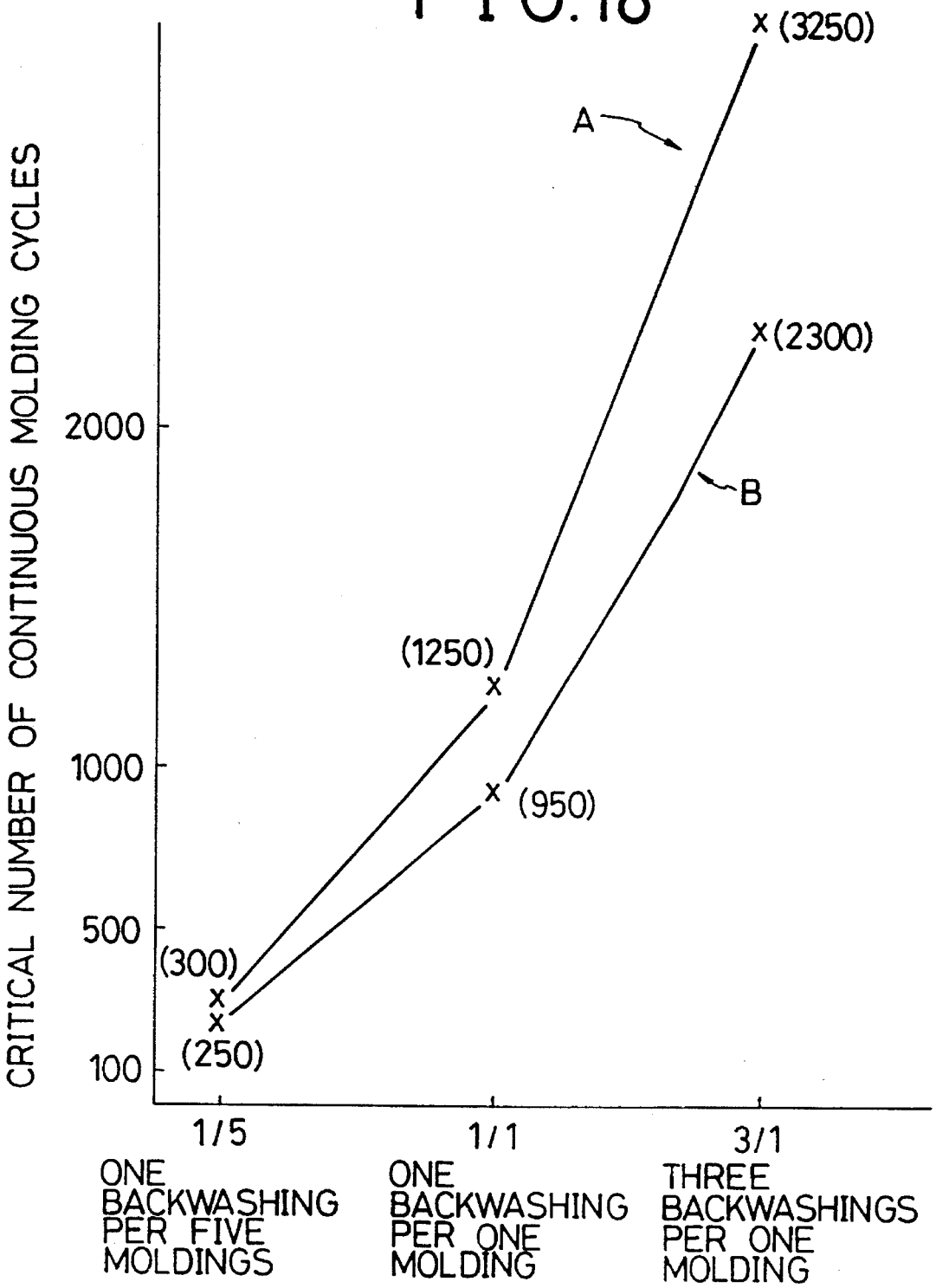
FIG. 18 is a graphic chart showing the result of Example 3.

The influence of the pulp mold A, which is the same mold as in Example 2, and the pulp mold B, which has the same structure as the mold used in No. 10 of Example 1, was evaluated. The effect of washing by a counter flow was evaluated by changing the ratio of the number of washing to the number of moldings. Under the same condition of washing by a counter flow, the maximum pressure emitted at the surface of the pulp mold A is 30 gf/cm$^2$, while that of the pulp mold B is 15 gf/cm$^2$. The result is shown in FIG. 18.

As obvious from the result of Examples 2 and 3, thousands of continuous moldings are made possible by using good combination of both the mold and tile backwashing condition of the present invention.

As described above, the pulp mold of the present invention has advantages in that it hardly suffers from clogging, it produces fiber bodies each having a smooth surface, it is free from damage caused by repeated use, it produces fiber bodies in a short period of time, and so on. Moreover, by tile method of the present invention, in which backwashing by pressurizing from inside the mold by using water and air after every molding, continuous molding without clogging becomes possible.

Additionally, the pulp mold of the present invention is much easier, in terms of time and effort, to construct than conventional wire mesh-type mods, and as such enables packaging manufactures to keep pace with constantly changing product configurations. Moreover, the overall cost of manufacturing packaging using the present invention is reduced when compared to that of wire mesh-type molds and conventional molding techniques.

Thus, by the present invention, fiber bodies can be mass produced by using old pulp, which can be re-formed, as a material. Therefore tile present invention contributes much to the development of industries as a pulp mold and the method for producing fiber bodies, which can solve the problems with conventional pulp molds and methods.

What is claimed is:

1. A method of molding shaped pulp articles from fiber pulp, comprising the steps of:

(1) providing a pulp mold comprising a molding layer providing at least a portion of a molding surface of said mold, formed by bonding first water-insoluble particles having an average particle size of 0.2–1.0 mm, said molding layer having a thickness 1–20 times the average particle size of said first particles; and a support layer located at the inner surface of said molding layer, formed by bonding second water-insoluble particles having an average particle size of 1.0–10.0 mm, wherein the average particle size of said second particles is larger than that of said first particles;

(2) molding a pulp article on said molding surface by suction through said mold;

(3) removing the molded pulp article from said mold; and (4) after repeating steps (2) and (3) at least once, applying cleaning water to said mold to incorporate water in at least one of the molding layer and the support layer of said mold, and thereafter applying air pressure to said mold from inside the mold to drive said incorporated water from the mold, thereby removing fibers trapped in said mold.

2. A method according to claim 1, wherein said cleaning water is incorporated at least in said molding layer.

3. A method according to claim 1, wherein said air pressure is applied as an impulse which rises to at least 1.0 $gf/cm^2$ at said molding surface of said mold in less than 0.5 seconds.

4. A method according to claim 3, further comprising connecting said mold to a volume of pre-compressed air to provide said air pressure.

5. A method according to claim 1, wherein said air pressure is applied so as to give a maximum pressure of at least 1.0 $gf/cm_2$ at said molding surface of said mold.

* * * * *